US006484573B2

(12) United States Patent
Bundock et al.

(10) Patent No.: US 6,484,573 B2
(45) Date of Patent: Nov. 26, 2002

(54) MONITORING EQUIPMENT FOR MONITORING THE PERFORMANCE OF AN ENGINE FUEL INJECTOR VALVE

(75) Inventors: Ronald Michael Bundock, Buckingham (GB); Ray Biggs, Aylesbury (GB)

(73) Assignee: Assembly Technology & Test Limited, London (GB)

( * ) Notice: Subject to any disclaimer, the term of this patent is extended or adjusted under 35 U.S.C. 154(b) by 0 days.

(21) Appl. No.: 09/730,040

(22) Filed: Dec. 5, 2000

(65) Prior Publication Data

US 2001/0032620 A1 Oct. 25, 2001

(30) Foreign Application Priority Data

Dec. 21, 1999 (GB) ..... 9930120

(51) Int. Cl.[7] ..... B21D 3/02
(52) U.S. Cl. ..... 73/119 A; 123/531
(58) Field of Search ..... 73/119 A, 865.8, 73/865.9; 123/531, 525, 533, 527

(56) References Cited

U.S. PATENT DOCUMENTS 3,875,792 A * 4/1975 Kronhn et al. ..... 73/119 A
4,037,467 A * 7/1977 Emerson ..... 73/119 A
4,453,403 A * 6/1984 Bussey et al. ..... 73/119 A
4,788,858 A * 12/1988 Liebermann ..... 73/119 A
6,311,553 B1 * 11/2001 Schoffel et al. ..... 73/119 A

* cited by examiner

*Primary Examiner*—Willis R. Wolfe
*Assistant Examiner*—Mahmoud Gimie
(74) *Attorney, Agent, or Firm*—Blackwell Sanders Peper Martin LLP

(57) ABSTRACT

Equipment for monitoring the performance of an engine fuel injector valve includes a source of pressurized fluid and an injector valve head connected to an injector valve and the source so that pressurized fluid is delivered to the valve. A regulator compensates for changes in pressure of the fluid and enables the change to be effected and maintained. A flow monitor is in the fluid path between the source and the head to monitor the flow of fluid. The source of pressurized fluid maintains a level of pressure in excess of a desired operating pressure. A fluid flow control coupled to a pressure sensor, near the test head indicates the pressure therein so that the flow control effects flow through the fluid path to maintain the pressure at the head.

7 Claims, 2 Drawing Sheets

MONITORING EQUIPMENT FOR MONITORING THE PERFORMANCE OF AN ENGINE FUEL INJECTOR VALVE

CROSS-REFERENCE TO RELATED APPLICATION

This application claims priority under 35 U.S.C. 119 to the foreign application number 9930120.2, filed on Dec. 21, 1999 in United Kingdom.

BACKGROUND OF THE INVENTION

The present invention relates to monitoring equipment for monitoring the performance of an engine fuel injector valve, comprising a source of pressurized fluid and an injector valve head provided with connection means to enable an injector valve to be connected thereto, the head being connected to the source so that pressurized fluid from the source is delivered to the injector valve when the equipment is in use, there being regulator means of the equipment to compensate for changes in pressure of the fluid at the head owing to pulsed operation of the injector valve when the equipment is in use, as well as to enable a change in pressure to be effected and maintained at the head, and flow monitoring means in the fluid path between the source and the head to monitor the flow of fluid to the head.

Hitherto, air piloted pressure regulators have been used as the regulator means. However, such equipment has suffered from a relatively slow response time to pressure changes, especially because of the use of air as the control medium. This results in an undesirable level of hysteresis using such equipment.

The present invention seeks to obviate this disadvantage.

SUMMARY OF THE INVENTION

Accordingly, the present invention is directed to monitoring equipment having the construction set out in the opening paragraph of the present specification, in which the source of pressurized fluid is such as to maintain a level of pressure in excess of a desired operating pressure, and in which the regulator means comprises fluid flow control means coupled to a pressure sensor, which is in or near the test head to provide an indication of the pressure therein so that the flow control means effects an increase or a decrease to flow of fluid through the said fluid path to maintain the pressure of the fluid at the head substantially at the desired operating pressure.

Preferably, the flow control means comprises a hydraulic amplifier arranged to operate valve means of the flow control means so as to effect such increase or decrease.

An especially fast response to changes of pressure is obtainable if the flow control means comprises a first movable member, transducer means which serves to provide a force which acts on and moves the first movable member in dependence upon the magnitude of an input signal delivered to the flow control means, two inputs connected to deliver pressurized fluid to opposite sides respectively of the first movable member and to opposite sides respectively of a second movable member, and output means from which fluid flows after it has reached the first movable member, in such a manner that movement of the first movable member in a first direction increases the resistance to flow of fluid from one of the two inputs to the said output means, so that pressure of fluid from that input urges the said second movable member in a given direction, whilst movement of the first movable member in a second direction, opposite to the first, increases the resistance to flow of fluid from the other of the said two inputs to the said output means, so that pressure of fluid from that other input urges the said second movable member in another direction opposite to the said given direction, the flow control means further comprising balancing means to balance the movement of the second movable member against the said force, and valve means which are opened to an extent which is dependent upon the position of the second movable member, whereby the extent to which the valve means is opened is dependent upon the magnitude of the input signal, so that the latter effects such increase or decrease.

Advantageously, the pressurized fluid delivered by the said two inputs is the pressurized fluid from the said source.

Preferably, the balancing means comprise a spring.

The valve means of the flow control means is preferably a slide valve, for example a spool valve.

BRIEF DESCRIPTION OF THE DRAWINGS

An example of monitoring equipment embodying the present invention will now be described with reference to the accompanying drawings, in which.

DETAILED DESCRIPTION OF THE PREFERRED EMBODIMENT

Figure 1:
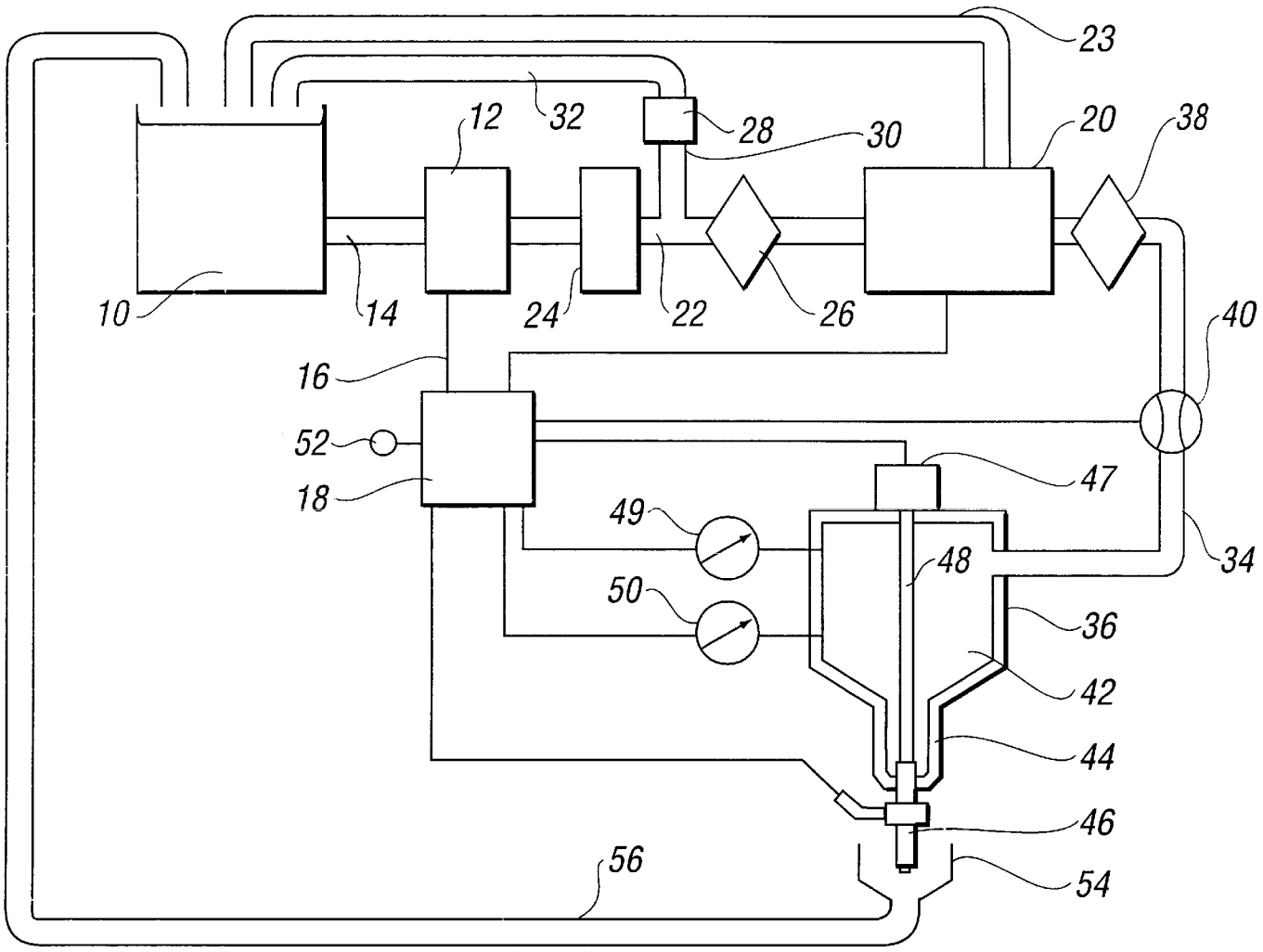
FIG. 1 shows a circuit diagram of the equipment.

The equipment shown in FIG. 1 comprises a tank 10 filled with test fluid. A pump 12 is connected to the tank 10 by way of the test fluid conduit 14. The pump 12 is connected electrically via a lead 16 to be controlled by a control processor 18.

The pump 12 is connected to deliver test fluid under a pressure of up to 400 bar to a precision servo-electro-hydraulic pressure control valve constituting a flow regulator 20 via a test fluid conduit 22. A return line 23 returns some of the test fluid from the regulator 20 back to the tank 10. A temperature controller 24 and a filter 26 are included in the conduit 22 for the purpose of maintaining the temperature of the test fluid and extracting dirt particles from it respectively. There is also a relief valve 28 connected to the conduit 22 via a T-branch 30. The other side of the relief valve 28 is provided with a return line 32 to return excess test fluid to the tank 10.

Continuing downstream from the flow regulator 20, the latter is connected via a further conduit 34 to enable test fluid to pass from the flow regulator 20 to an injector valve test head 36. A filter 38 and a flow meter 40 are connected respectively in the conduit 34 to further clean the test fluid and to provide a measurement of the flow rate of test fluid to the test head 36 respectively.

The test head 36 is hollow so as to provide a test fluid chamber 42 which is in communication with the conduit 34. A connector 44 is provided on the test head 36 to enable an injector valve 46 under test to be connected to the test head in such a fashion as to receive test fluid from the cavity 42. An injector valve adjuster 47 is connected to enable adjustment of the injector valve 46 via an adjustment rod 48.

A pressure sensor 49 and a temperature sensor 50 are positioned to measure the pressure and temperature respectively of the test fluid in the cavity 42. Electrical connections are made respectively from the flow meter 40, the pressure sensor 49 and the temperature sensor 50 to inputs of the control processor 18, and electrical connections are made from outputs of the control processor 18 respectively to the pump 12, the flow regulator 20, the injector valve 46 under test, and the injector valve adjuster 47.

A further output 52 from the control processor 18 provides data for display and/or recordal, including in particular cumulative values of the volume of test fluid which is injected through the injector valve 46 per injection.

A collecting vessel 54 is located to receive test fluid released from the injector valve 46, and the return line 56 enables this collected test fluid to be returned to the tank 10.

Figure 2:
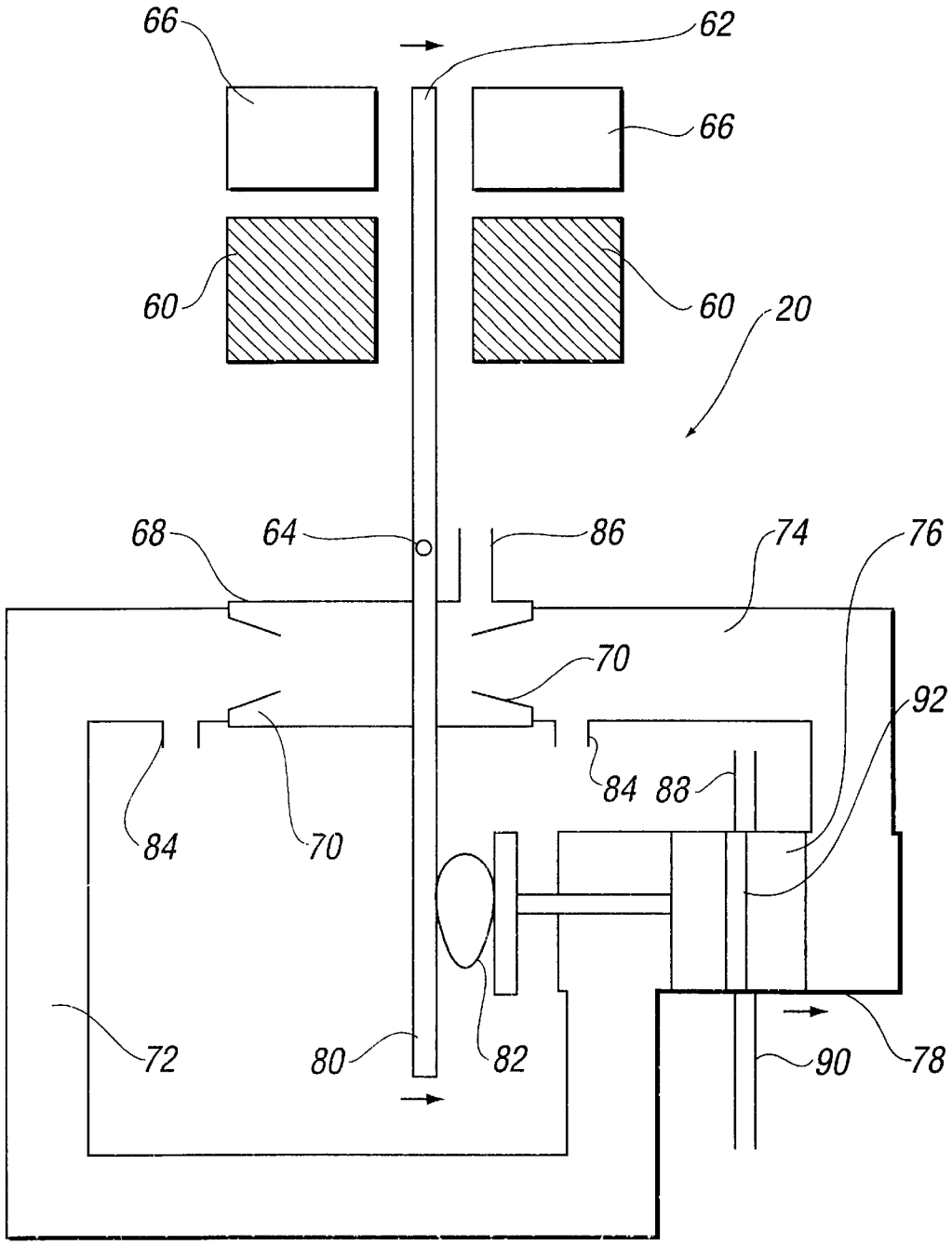
FIG. 2 shows a diagram of flow control means of the equipment shown in FIG. 1.

Further details of the flow regulator 20 are shown in FIG. 2. Such a device is particularly accurate and fast in correcting for or adjusting the pressure of test fluid in the cavity 42.

The flow regulator 20 comprises an electrical coil 60 which surrounds a magnetizable rocker 62 pivotally mounted about a pivot 64. Permanent magnets 66 are arranged at an end of the rocker 62 which is beyond the coil 60, to create a magnetic field, the lines of which extend transversely of the rocker 62.

Located around the rocker 62 on the side of the pivot 64 thereof which is further from the coil 60 is a hollow flexible walled housing 68 which forms a seal around the rocker 62 without preventing rocking of the rocker 62 about its pivot 64. Two inwardly directed opposing nozzles 70 are provided within the housing 66 are connected to cavities 72 and 74, connected respectively to the two nozzles 70.

These cavities 72 and 74 are in communication respectively with opposite sides of a slider 76 of a slide valve 78. The slider 76 is coupled to the end 80 of the rocker 62 which is further from the permanent magnet 66 via a spring 82.

Test fluid inlets 84 open into the cavities 72 and 74 respectively and test fluid outlet 86 provides an outlet from the interior of the housing 68. The outlet 86 is connected to the return line 23 of FIG. 1. The slide valve 78 is provided with an inlet 88 and outlet 90 connected respectively to the conduits 22 and 34. The inlet 88 and outlet 90 are in alignment with one another. A bore 92 through the slide 76 connects the outlet 90 to the inlet 88, and the effective available cross-section for test fluid passing through the bore 92 is determined to the extent to which the latter is in registration with the inlet and outlet 88 and 90, which in turn is dependent upon the axial position of the slide 76 within the slide valve 78.

Operation of the equipment is as follows. The injector 46 under test is secured to the head 36 by way of the connector 44. Test fluid from the tank 10 is pumped into the system by way of the pump 12 and air is purged from all cavities and conduits in the system. The pump is set to operate by the control processor 18 at a pressure slightly higher than the desired pressure for test fluid within the head 36. Test fluid is urged by the pump 12 into the conduit 22 so that it passes through the temperature controller 24 and the filter 26 to ensure that it has the right temperature and cleanliness, respectively. Test fluid continues from the conduit 22 through the flow regulator 20, the further filter 38, and the flow meter 40 before it reaches the test head 36. The control processor 18 operates the injector valve 46 so that the latter is caused to inject fluid into the collecting vessel 54 from the interior 42 of the test head 36.

The output from the flow meter 40 fed to the control processor 18 enables the latter to provide data output signals at its output 52 indicative of the volume of fluid discharged from the injector valve per injection. If desire or necessary, an adjustment may be made to the injector valve 46 by the control processor 18 via the injector valve adjuster 47 and the adjustment rod 48.

The temperature sensor 50 enables an adjustment to be made to the output data signals at the output 52 by the control processor 18 to compensate for any difference in temperature between the desired temperature and the actual temperature. It also enables the control processor 18 to transmit a control signal to the temperature control 24 to adjust the temperature of test fluid flowing therethrough and thereby bring the temperature in the test head 36 closer to the desired temperature.

In the event that the pressure in the test head interior 42 as indicated by the sensor 48 differs from the desired pressure, this is compensated for by the control processor 18, which detects this difference by virtue of the electrical connection it has with the pressure sensor 48, and changes its control output to the flow regulator 20 accordingly. The manner in which the flow controller 20 operates will now be described with reference to FIG. 2.

Pressurized test fluid from the conduit 22 is fed to the inlet 88, via the bore 92 to the outlet 90, the amount of flow through the bore 90 being determined by the extent to which the latter is in registration with the aligned inlet and outlet 88 and 90, respectively.

Pressurized test fluid from the conduit 22 is also fed through the inlets 84 to fill the cavities 72 and 74. Test fluid flows from the cavities 72 and 74, via the nozzles 70 within the housing 68 and out from the housing 68 via the outlet 86 from whence it is returned via the return line 23 to the tank 10. In the event that the electrical current through the coil 60 is increased, so as to magnetize the rocker 62 to a greater extent so that the end 62 thereof moves in the direction of the arrow-head shown adjacent thereto towards the right viewing in the direction of the diagram, a portion of the rod 62 immediately below the pivot 64 will then move closer to the nozzle 70 connected to the cavity 72 than it is to the other nozzle 70. This reduces the extent to which test fluid can now flow from the cavity 72, with the result that the pressure therein increases and urges the slider 76 in the direction of the arrow shown adjacent thereto towards the right viewing the apparatus in the manner shown in FIG. 2. This pulls the end 80 of the rocker 62 in the direction of the arrow shown adjacent thereto towards the right viewing the apparatus as in FIG. 2 so as to increase the flow of test fluid through the nozzle 70 connected to the cavity 72. Ultimately, a balanced position for the rocker 62 is achieved once again, but with the slider 76 moved further towards the right so that the force acting at the lower end of the rocker 62 compensates the force acting on the upper end of the rocker 62. A corresponding movement of the slider 76 in the opposite direction will follow a decrease in the current through the coil 60 and a momentary increase in the pressure of test fluid in the cavity 74. In this way the flow through the bore 92 is proportional to the current passed through the coil 60. A very rapid compensation to the flow through the regulator 20 to compensate for any change in pressure at the head 36 is thereby achieved by virtue of the hydraulic amplifier which includes the cavities 72 and 74.

In the event that a change in pressure is desired at the test head 36 during the course of the test procedure, the control processor 18 changes the electrical current delivered to the coil 60 of the flow regulator 20 and the flow regulator 20 speedily brings the value of the pressure of the test fluid in the test head 36 to the new desired pressure.

The illustrated equipment may provide the following advantages:

Very fast transient response times so that pressure changes can be achieved in less than 0.5 seconds.

Very accurate pressure control over a wide pressure range. Tests have shown control to better than +/−0.05% of value for both steady state and transient flow changes.

Operation with low viscosity test fluids (this is outside the normal operating viscosity range for this type of valve).

Insensitivity to pulsations caused by the injector.

Insensitivity to flow changes caused by changes to the injector duty cycle.

Numerous variations and modifications to the illustrated equipment may occur to the reader without taking the resulting construction outside the scope of the present invention.

To give one example, a gas spring may be provided to dampen the oscillatory changes of the pressure of the test fluid in the interior 42 of the test head 36. The slide valve 78 may be in the form of a spool valve.

Another example of a modification would be the use of a pressure control valve with a return line when the injector is switched off to cope with any excess flow under those conditions.

We claim:

1. Monitoring equipment for monitoring the performance of an engine fuel injector valve comprising: a source of pressurized fluid and an injector valve head provided with a connector to enable an injector valve to be connected thereto, the head being connected to the source of pressurized fluid so that pressurized fluid is delivered to the injector valve when the equipment is in use, a regulator to compensate for changes in pressure of the fluid at the injector valve head owing to pulsed operation of the injector valve when the equipment is in use, as well as to enable a change in pressure to be effected and maintained at the injector valve head, and a flow monitor in the fluid path between the source of pressurizing fluid and the injector valve head to monitor the flow of fluid to the injector valve head, wherein the source of pressurized fluid is such as to maintain a level of pressure in excess of a desired operating pressure, and wherein the regulator includes a fluid flow control coupled to a pressure sensor, which is at the test head to provide an indication of the pressure therein so that the flow control effects an increase or a decrease to flow of fluid through the fluid path to maintain the pressure of the fluid at the injector valve head substantially at the desired operating pressure.

2. Monitoring equipment according to claim 1, wherein the flow control comprises an hydraulic amplifier arranged to operate a valve of the flow control so as to effect such increase or decrease.

3. Monitoring equipment according to claim 1, wherein the flow control comprises a first movable member, a transducer which serves to provide a force which acts on and moves the first movable member is dependent upon the magnitude of an input signal delivered to the flow control, two inputs connected to deliver pressurized fluid to opposite sides respectively of the first movable member and to opposite sides respectively of a second movable member, and an output from which fluid flows after it has reached the first movable member, in such a manner that movement of the first movable member in a first direction increases the resistance to flow of fluid from one of the two inputs to the side output, so that pressure of fluid from that input urges the second movable member in a first given direction, whilst movement of the first movable member in a second direction, opposite to the first given direction, increases the resistance to flow of fluid from the other of the two inputs to the output, so that pressure of fluid from the other input urges the second movable member in another direction opposite to the given direction, the flow control further comprising balancing means to balance the movement of the second movable member against the force, and a valve which is opened to an extent which is dependent upon the position of the second movable member, whereby the extent to which the valve is opened is dependent upon the magnitude of the input signal, so that the latter effects such increase or decrease.

4. Monitoring equipment according to claim 3, wherein the pressurized fluid delivered by the two inputs is the pressurized fluid from the source.

5. Monitoring equipment according to claim 3, wherein the balancing means comprise a spring.

6. Monitoring equipment according to claim 3, wherein valve of the flow control is a slide valve.

7. Monitoring equipment according to claim 6, wherein the slide valve is a spool valve.

* * * * *